United States Patent [19]

Nobue et al.

[11] 4,415,789

[45] Nov. 15, 1983

[54] MICROWAVE OVEN HAVING CONTROLLABLE FREQUENCY MICROWAVE POWER SOURCE

[75] Inventors: Tomotaka Nobue; Shigeru Kusunoki, both of Yamatokoriyama, Japan

[73] Assignee: Matsushita Electric Industrial Co. Ltd., Osaka, Japan

[21] Appl. No.: 326,924

[22] Filed: Dec. 2, 1981

[30] Foreign Application Priority Data

| | | | |
|---|---|---|---|
| Dec. 10, 1980 | [JP] | Japan | 55-174305 |
| Dec. 11, 1980 | [JP] | Japan | 55-175553 |
| Dec. 11, 1980 | [JP] | Japan | 55-175554 |

[51] Int. Cl.[3] ..... H05B 6/68

[52] U.S. Cl. ..... 219/10.55 B; 219/10.55 R; 219/10.55 F; 333/228; 333/231

[58] Field of Search ..... 219/10.55 B, 10.55 R, 219/10.55 F; 333/17 R, 227, 228, 231

[56] References Cited

U.S. PATENT DOCUMENTS

| | | | |
|---|---|---|---|
| 3,104,304 | 9/1963 | Sawada | 219/10.55 B |
| 3,461,401 | 8/1969 | Williams | 219/10.55 B X |
| 4,009,359 | 2/1977 | Tallmadge et al. | 219/10.55 B |
| 4,196,332 | 4/1980 | Mackay et al. | 219/10.55 B |
| 4,210,795 | 7/1980 | Lentz | 219/10.55 B |

*Primary Examiner*—B. A. Reynolds
*Assistant Examiner*—Philip H. Leung
*Attorney, Agent, or Firm*—Spencer & Frank

[57] ABSTRACT

A microwave oven comprising a heating cavity, a controllable frequency microwave power source, a detector for detecting the intensity of the electric field in the cavity and control means for setting the microwave power source at the frequency as determined by the intensity of the electric field. The frequency at which the loaded cavity is energized is selected by the control means to store high power in the cavity. The dimensions of the cavity are selected for generating only the $TE_{m0p}$ mode at the frequency of the microwave power source which is limited to 915±13 MHz, where 0 is the mode index in the direction of the height of the cavity.

10 Claims, 4 Drawing Figures

MICROWAVE OVEN HAVING CONTROLLABLE FREQUENCY MICROWAVE POWER SOURCE

BACKGROUND OF THE INVENTION

This invention relates to a microwave oven having a controllable frequency microwave power source, and more particularly to a microwave oven in which the oscillation frequency of its microwave power source is controlled depending on the load to be heated.

One of the main attractions of modern microwave ovens is that they can provide automatic heating. When an automatic heating system is employed, the level of output power of the microwave power source is controlled in a time division mode depending on the load to be heated. In a domestic or home-use microwave oven, a magnetron is employed as the microwave power source, and the microwave power generated from the magnetron is provided to the oven cavity to heat a load placed in the oven cavity to be heated with the microwave power. It is acknowledged that, in the microwave power generated from the magnetron, the proportion of the microwave power contributing to the heating of a load placed in the oven cavity (which proportion of power will be referred to hereinafter as available power) varies depending on the kind and amount of the load. Generally, the smaller the size of the load, the less the available power.

This is mainly due to a poor impedance match between the magnetron and the loaded oven cavity. How the heating efficiency of the modern microwave oven comprising an advanced automatic heating system can be maintained high for all types of loads to be heated is a technical problem to be solved from, among others, the viewpoint of energy saving.

In order that the microwave oven can operate with high heating efficiency, it is required to maintain a satisfactory impedance match between the loaded oven cavity and the microwave power source providing microwave power to this oven cavity.

Measures for maintaining a satisfactory impedance match between the loaded oven cavity and the microwave power source are classified into those in which one is to make variable the mechanism of the microwave transmission system and the other is to make variable the oscillation frequency of the microwave power source. U.S. Pat. No. 3,104,304 to Sawada employs the former measures and attempts to improve the heating efficiency by manipulating the electric field patterns in the oven cavity by changing the physical dimensions of the oven cavity.

The problem involved in this U.S. patent is the limitation placed on the load to be heated in order to maintain high efficiency. Further, to manipulate the electric field patterns in the cavity is not always effective in ensuring high efficiency.

U.S. Pat. No. 4,196,332 to MacKay B et al employs the latter measures and attempts to improve the efficiency by controlling the oscillation frequency of the microwave power source on the basis of the levels of reflected power from the oven cavity thereby maintaining a satisfactory impedance match between the microwave power source and the loaded oven cavity. A microwave oven having a controllable frequency microwave power source can maintain high efficiency for any load to be heated. However, the multimode cavity has the defects that the electromagnetic modes in the loaded cavity change as the load is being heated and/or that the initial resonant frequencies generating the electromagnetic modes in the loaded cavity shift to other frequencies as the load is being heated. The frequency generating the electromagnetic mode in the loaded cavity is generally correlated to the frequency reducing the reflected power from the loaded cavity. According to this description, in this cited microwave oven having a multimode cavity for receiving a load to be heated, to operate the microwave power source at frequencies at which the initial reflected power levels from the loaded cavity are below the predetermined reflected power level, reduces the efficiency for a special load as the load is being heated.

It is acknowledged that the selection of electromagnetic modes, i.e., the selection of electric field patterns or distributions in the oven cavity is an important factor for attaining uniform heating of a load to be heated. The selection of the electric field patterns is equivalent to the selection of the dimensions of the width, height and depth of the oven cavity. However, even when an oven cavity is so determined, all of a plurality of electric field patterns, i.e., electromagnetic modes established in the oven cavity cannot always contribute to the attainment of uniform heating of the load. Further, even when the electromagnetic mode suitable for attaining uniform heating of the load may be selected, it is impossible, as a matter of fact, to select the mode in accordance with the amount of reflected power detected from the multimode oven cavity. The information available as a result of the detection of the amount of reflected power teaches only that some electromagnetic modes are present in the oven cavity although the details of the electric field patterns are unknown. In the invention of MacKay B et al, the load is heated with microwave power at a plurality of frequencies generating different electric field patterns so as to attain uniform heating of the load, in an attempt to obviate the difficulty pointed out above. However, the frequencies are determined on the basis of the detector signal representative of the amount of reflected power in the initial condition of heating of the load. Therefore, in the case of a load whose physical properties tend to change with the progress of heating, the impedance match between the microwave power source and the loaded oven cavity will not always be maintained in a satisfactory state throughout the duration of heating.

SUMMARY OF THE INVENTION

It is therefore a main object of this invention to provide a microwave oven capable of operating with improved efficiency for any loads and for all heating times. This object is achieved by the provision of a microwave oven which includes a cavity for receiving a load to be heated, in which a limited electromagnetic mode is generated within a predetermined frequency range, and a controllable frequency microwave power source coupled to the cavity for providing power to the cavity. This microwave power source operates at a controllable frequency within the predetermined frequency range. The oven further includes a detector for detecting the intensity of the electric field which is generated in the loaded cavity when the cavity is energized, and a control system for determining a preferable operating frequency within the operating bandwidth and for controlling the microwave power source to provide output power to the cavity at the preferred frequency according to the detector signal.

It is another object of this invention to provide a microwave oven with a simple control system for controlling the frequency of the microwave power source within the predetermined frequency range.

This object is achieved by the provision of a microwave oven which includes a cavity having the dimensions for generating only the $TE_{m0p}$ mode and a controllable frequency microwave power source having an operating frequency which is limited to 915±13 MHz. The control system in this oven is merely required to search only one frequency at which efficiency is the highest, because this cavity has only one resonant frequency within this bandwidth.

It is still another object of this invention to provide a microwave oven with a frequency control system having improved handling capability.

This object is achieved by the provision of a microwave oven which includes a control lever arranged in a control panel of this oven for controlling a voltage ramp generator coupled to the controllable frequency microwave power source to control the power source frequency within the predetermined frequency range.

In accordance with another aspect of this invention, the cavity having the dimensions for generating only the $TE_{m0p}$ mode can be easily constituted without requiring accuracy of the dimension in the direction of height of the cavity, where m is the mode index in the direction of width of the cavity, 0 is the mode index in the direction of height and p is the mode index in the direction of depth.

BRIEF DESCRIPTION OF THE DRAWINGS

The above and other objects, features and advantages of the present invention will become more apparent from the following detailed description of preferred embodiments thereof taken in conjunction with the accompanying drawings, in which.

DESCRIPTION OF THE PREFERRED EMBODIMENTS

Preferred embodiments of the present invention will now be described in detail with reference to the drawings.

Figure 1:
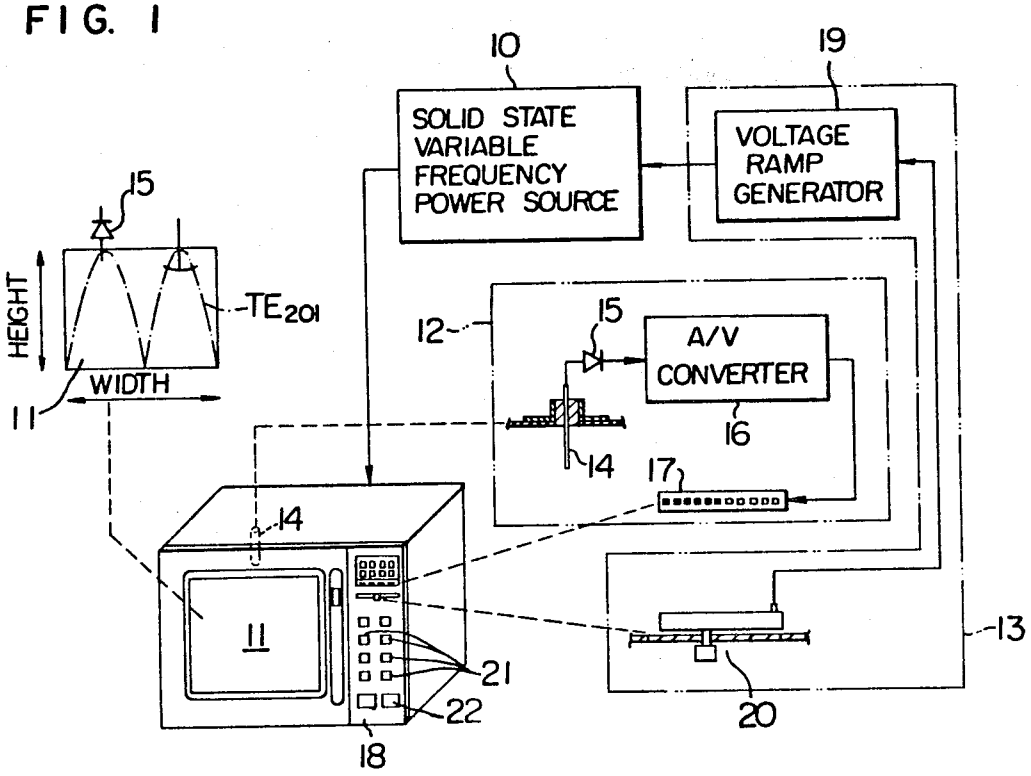
FIG. 1 is a block diagram showing the structure of a preferred embodiment of the microwave oven system according to the present invention.

FIG. 1 of the drawings is a block diagram showing the structure of a preferred embodiment of the microwave oven system according to the present invention.

Referring to FIG. 1, the microwave oven comprises a solid state variable frequency power source 10 providing a controllable frequency microwave power source whose operating frequency band is 915±13 MHz, and a cavity 11 dimensioned to generate a specific transverse electric mode or $TE_{201}$ mode in this frequency band to provide a standing wave in which the components in the directions of width, height and depth of the cavity are 2, 0 (=0) and 1 respectively. The microwave oven further comprises detector means 12 for detecting the resonance frequency generating the $TE_{201}$ mode in the loaded cavity 11, and control means 13 for controlling the operating frequency of the solid state variable frequency power source 10 on the basis of the output signal of the detector means 12.

The detector means 12 includes a pole antenna 14 coupled to the electric field in the cavity 11 to detect the intensity of the electric field, a crystal diode 15 detecting the signal indicative of the electric field intensity detected by the pole antenna 14, an A/V converter 16 converting the output signal of the crystal diode 15 into a corresponding DC voltage, and an indicator 17 indicating the level of the DC voltage. The indicator 17 may be a level meter including a plurality of light-emitting diodes emitting light to indicate the level proportional to that of the DC voltage. This level meter 17 is disposed in a control panel 18 mounted on the front wall of the microwave oven.

The control means 13 includes a voltage ramp generator 19 generating a predetermined voltage as a control signal for setting the operating frequency of the solid state variable frequency power source 10 at the desired value, and a control part 20 disposed in the control panel 18 to be manually actuated to control the output voltage of the voltage ramp generator 19. This control part 20 may be a control lever.

The operation of the microwave oven will now be described. A load to be heated is placed in the oven cavity 11, and necessary heating information is supplied by depression of a necessary one of keys 21 disposed on the control panel 18. Then, when a start key 22 is depressed on the control panel 18, the solid state variable frequency power source 10 supplies microwave power at the operating frequency of 915 MHz to the oven cavity 11. At the same time, the level meter 17 disposed in the control panel 18 emits light to indicate the level proportional to the intensity of the electric field produced in the oven cavity 11. The user shifts the control part 20 until the level of luminant indication by the level meter 17 becomes maximum. At the time the level meter 17 indicates the maximum level, the $TE_{201}$ mode is generated in the loaded cavity 11. At this time too, there is a satisfactory impedance match between the solid state variable frequency power source 10 and the loaded cavity 11, and, also, the microwave heating is being carried out with high efficiency.

Figure 2:
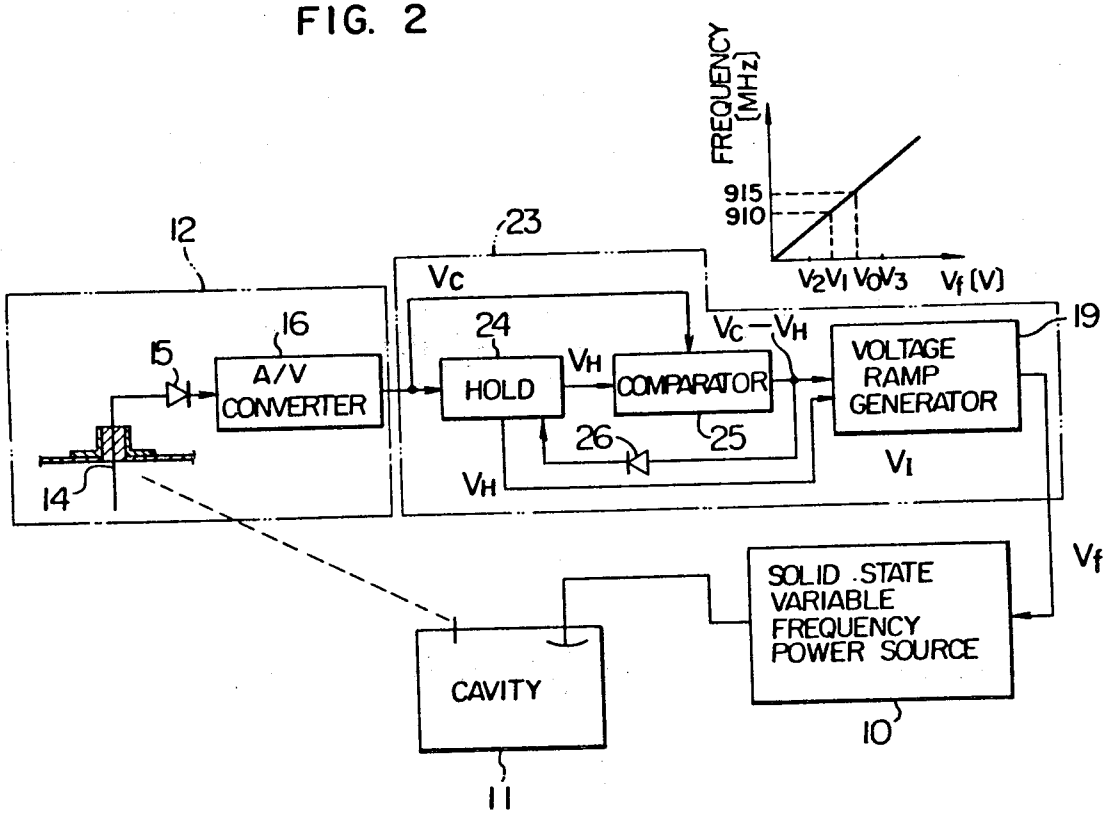
FIG. 2 is a block diagram showing the structure of another preferred embodiment of the microwave oven system according to the present invention.

FIG. 2 is a block diagram showing the structure of another preferred embodiment of the microwave oven system according to the present invention.

The microwave oven shown in FIG. 2 differs from that shown in FIG. 1 in that the voltage ramp generator 19 generating the control signal controlling the operating frequency of the solid state variable frequency power source 10 is automatically controlled. In this second embodiment, the detector means 12 detecting the intensity of the electric field in the oven cavity 11 to detect the resonance frequency of the oven cavity 11 includes similarly a pole antenna 14, a crystal diode 15 and an A/V converter 16 generating a DC voltage as the output signal of the detector means 12. On the other hand, the control means 23 includes a hold circuit 24 holding the DC voltage level corresponding to the intensity of the electric field produced in the oven cavity 11 at the heating starting time, a comparator 25, and a voltage ramp generator 19.

The operation of the control means 23 in the second embodiment will now be described. At the time heating is started, the level of the output voltage $V_f$ of the voltage ramp generator 19 which controls the operating frequency, is $V_o$ at which the solid state variable frequency power source 10 generates microwave power at the operating frequency of 915 MHz. At this time, the A/V converter 16 generates its output voltage $V_H$ ($=V_C$) proportional to the intensity of the electric field produced in the oven cavity 11, and the voltage ramp generator 19 compares this output voltage $V_H$ ($=V_C$) of the A/V converter 16 with a voltage $V_I$ indicative of a predetermined electric field intensity. When the result of comparison proves that $V_I > V_H$, the output voltage $V_f$ of the voltage ramp generator 19 is forcibly shifted to a predetermined voltage level, e.g., a voltage level $V_1$ at which the operating frequency of the solid state variable frequency power source 10 is 910 MHz. Then, the A/V converter 16 generates its output voltage $V_C$ proportional to the intensity of the electric field produced in the oven cavity 11 in response to the operating frequency of 910 MHz. This output voltage $V_C$ of the A/V converter 16 is compared in the comparator 25 with the output voltage $V_H$ having appeared from the A/V converter 16 at the operating frequency of 915 MHz and held in the hold circuit 24, and the resultant output voltage output signal ($V_C - V_H$) appears from the comparator 25. When the intensity of the electric field produced in the oven cavity 11 at the operating frequency of 910 MHz is higher than that at the operating frequency of 915 MHz, when the relation $V_C > V_H$ holds, the output voltage $V_f$ of the voltage ramp generator 19 is shifted to a level, e.g., $V_2$ at which the operating frequency is lower than 910 MHz. When, on the other hand, the intensity of the electric field produced in the oven cavity 11 at the operating frequency of 915 MHz is higher than that at the operating frequency of 910 MHz, hence, when the relation $V_C < V_H$ holds, the output voltage $V_f$ of the voltage ramp generator 19 is shifted to a level, e.g., $V_3$ at which the operating frequency is higher than 915 MHz. When the relation is given by $V_C \approx V_H$, the output voltage $V_f$ of the voltage ramp generator 19 is maintained at the level $V_1$ at which the operating frequency is 910 MHz. Further, at the time at which the relation $V_C \neq V_H$ holds, the hold circuit 24 is reset, and the value of $V_C$ at that time is newly held as $V_H$. The above-described operation of the control means 23 is continuously carried out throughout the duration of heating within the entire frequency band in which the solid state variable frequency power source 10 is operable, and the frequency providing the maximum electric field intensity is continuously selected. A diode 26 acts to prevent flow of reverse current.

When the initially detected level of the signal $V_H$, which is equal to $V_C$ at that time, is higher than that of $V_I$, hence, when the maximum electric field intensity occurs in the oven cavity 11 at a frequency close to 915 MHz, the output voltage $V_f$ of the voltage ramp generator 19 is maintained at the level $V_o$ at which the operating frequency of the solid state variable frequency power source 10 is 915 MHz.

The above description has clarified the structure of the two systems employed in the present invention for controlling the operating frequency of the solid state variable frequency power source 10.

Figure 3:
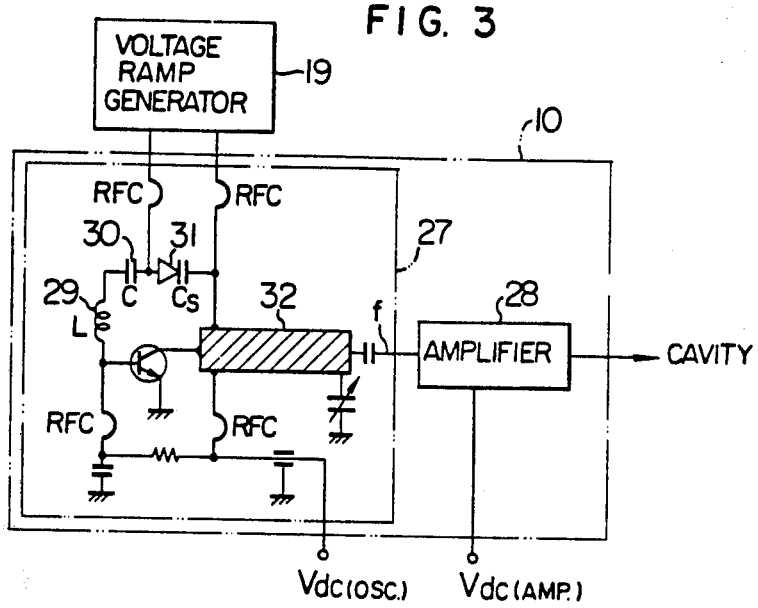
FIG. 3 shows schematically the structure of one form of the controllable frequency microwave power source preferably employed in the present invention.

FIG. 3 shows schematically the structure of one form of the controllable frequency microwave power source preferably employed in the present invention. The solid state variable frequency power source 10 functioning as the controllable frequency microwave power source is composed of an oscillator unit 27 and an amplifier unit 28.

The oscillator unit 27 includes a clamp type oscillator, and its oscillation frequency f is given by $$f = \frac{1}{2\pi\sqrt{L\left(\frac{C \cdot C_S}{C + C_S}\right)}}$$

where L is the inductance of a coil 29, C is the capacitance of a capacitor 30, and $C_S$ is the capacitance of varactor 31. It is the voltage ramp generator 19 which applies the voltage across the varactor 31. Reference symbols RFC designate radio frequency chokes, and the hatched portion represents an oscillator output matching circuit provided by a microstrip line.

Figure 4:
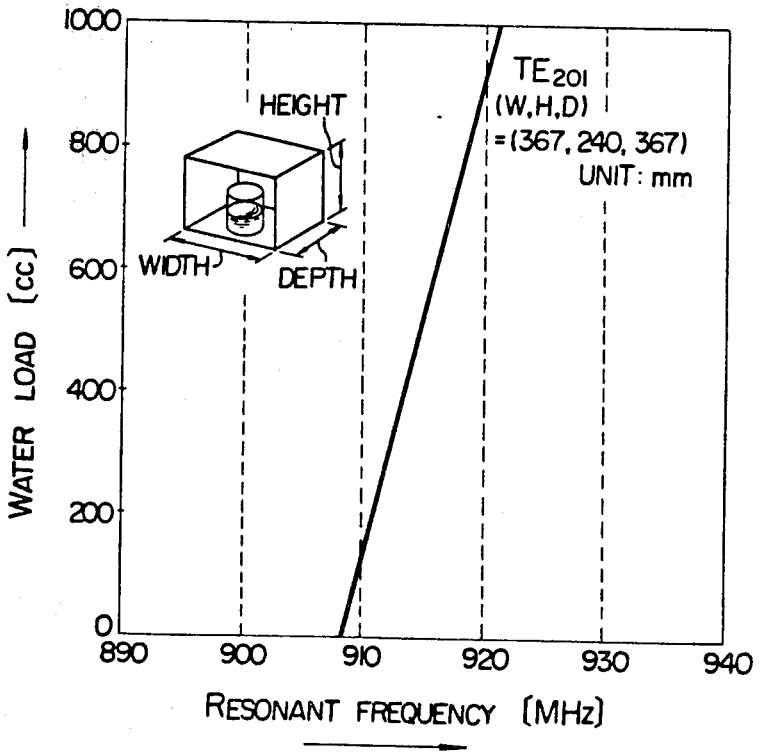
FIG. 4 is a graph showing the relation between the resonant frequency and the amount of a load of water placed in the oven cavity in which a $TE_{201}$ mode appears at frequencies in a band centered on of 915 MHz.

FIG. 4 is a graph showing the relation between the resonant frequency and the amount of a load of water placed in the oven cavity 11 in which the $TE_{201}$ mode appears at the operating frequency of 915 MHz band.

While the foregoing description has referred principally to the means for controlling the solid state variable frequency power source 10, the resonant frequency characteristic of the oven cavity 11 will now be described in detail with reference to FIG. 4. The dimensions of the oven cavity used for the measurement of the resonant frequency characteristic are 367 mm, 240 mm and 367 mm in width, height and depth respectively.

The resonant frequency $f_R$ of the oven cavity in a no-loaded condition is expressed as a function of the dimensions of the oven cavity and the electromagnetic mode generated in the oven cavity, as is commonly known. Thus, $f_R$ is given by $$f_R = v_o \times \sqrt{\left(\frac{m}{2a}\right)^2 + \left(\frac{n}{2b}\right)^2 + \left(\frac{p}{2c}\right)^2}$$

where $v_o$: velocity of light in vacuum a, b, c: width, height and depth of the oven cavity respectively m, n, p: mode indices of the electromagnetic mode generated in the oven cavity, in the directions of width, height and depth respectively (positive integers)

According to the above equation, $f_R$ is calculated to be $$f_R = 913.3 \text{ MHz}$$

when the $TE_{201}$ mode ($m=2$, $n=0$, $p=1$) appears under the no-loaded condition in the oven cavity having the dimensions above described.

The oven cavity having above-described dimensions is featured by the fact that the dimensions are so selected that only the $TE_{201}$ mode (to which the $TE_{102}$ mode is equivalent) appears in the oven cavity in the frequency band of 915±13 MHz. Further, it is also featured by the fact that this $TE_{201}$ mode appearing in the oven cavity is selected to be an electromagnetic mode having no standing wave in the direction of height of the oven cavity. FIG. 4 shows the water load amount vs. resonant frequency characteristic in the oven cavity having the above features. It can be seen from FIG. 4 that the resonant frequency of the oven cavity varies depending on the amount of water which is the load to be heated. That is, the resonant frequency of an oven cavity is dependent upon the kind, amount and state of a load placed in the oven cavity. Therefore, in an oven cavity in which a multimode appears in a no-load condition, an undesirable electromagnetic mode may be generated during heating a load to be heated. It is acknowledged that, during operation of a microwave power source supplying microwave power to an oven cavity at a frequency which generates an electromagnetic mode in the oven cavity, the amount of power reflected from the oven cavity toward the microwave power source is much less than that of the power reflected from the oven cavity when the microwave power source supplies microwave power to the oven cavity at a frequency which does not generate an electromagnetic mode in the oven cavity. This is because the oven cavity resonates and stores a large quantity of microwave power therein. For this reason, it is impractical to conclude, by merely detecting the amount of reflected power from the oven cavity, that the specific electromagnetic mode generated in the oven cavity, when it is a small amount of reflected power, is suitable for satisfactorily heating a load with microwave power. The present invention remedies the drawback pointed out above. According to the present invention, the $TE_{m0p}$ mode, which does not have any standing wave in the direction of height of the oven cavity, is selected as a preferable electromagnetic mode so that, independently of the kind, amount and state of various loads to be heated, the oven cavity can resonate in the operating frequency band of the microwave power source. The dimensions of the width, height and depth of the oven cavity are determined on the basis of the $TE_{m0p}$ mode thus selected, and FIG. 4 shows, by way of example, the water load amount vs. resonant frequency characteristic of the oven cavity having the dimensions so determined.

What is claimed is:

1. A microwave oven comprising:

a cavity for receiving a load to be heated, said cavity having width, height and depth dimensions for generating a single electromagnetic mode including a $TE_0$ mode within a predetermined frequency range, said $TE_0$ mode having a uniform electric field distribution along the height dimension of said cavity;

a controllable frequency microwave power source for providing power to said cavity, the operating frequency of said microwave power source being controllable within said predetermined frequency range;

detector means for providing a detector signal indicative of the electric field intensity of said cavity when said cavity is loaded and energized; and control means for controlling the operating frequency of said microwave power source according to said detector signal to obtain a maximum electric field intensity within said cavity.

2. A microwave oven as claimed in claim 1, wherein the operating frequency of said controllable frequency microwave power source is limited to 915±13 MHz.

3. A microwave oven as claimed in claim 1 or claim 2, wherein said control means includes a voltage ramp generator coupled to said microwave power source for controlling the power source frequency within the predetermined frequency range.

4. A microwave oven as claimed in claim 1 or claim 2, wherein said detector means includes first means for coupling to the electric field generated within said cavity when the loaded cavity is energized and second means for generating a DC voltage corresponding to the intensity of said electric field to provide said detector signal.

5. A microwave oven as claimed in claim 1 or claim 2, wherein said detector means includes first means for coupling to the electric field generated within said cavity when the loaded cavity is energized, second means for generating a DC voltage corresponding to the intensity of said electric field, and an indicator, arranged in a control panel of said microwave oven, for providing said detector signal, said indicator emitting light in proportion to said DC voltage.

6. A microwave oven as claimed in claim 4, wherein said first means is a pole antenna and said second means is a crystal diode.

7. A microwave oven as claimed in claim 5, wherein said first means is a pole antenna, said second means is a crystal diode, and said indicator is a level meter with light emitting diodes.

8. A microwave oven as claimed in claim 5, wherein said control means includes a control part arranged in said control panel of said microwave oven for controlling a voltage ramp generator coupled to said controllable frequency microwave power source to control the power source frequency within the predetermined frequency range.

9. A microwave oven as claimed in claim 1 or claim 2, wherein said controllable frequency microwave power source is a solid state variable frequency source.

10. A microwave oven comprising:

a cavity for receiving a load to be heated, said cavity having width, height and depth dimensions for generating a single electromagnetic mode including a $TE_0$ mode within a predetermined frequency range of 915±13 MHz, said $TE_0$ mode having a uniform electric field distribution along the height dimension of said cavity;

a controllable frequency microwave power source for providing power to said cavity, the operating frequency of said microwave power source being controllable within said predetermined frequency range;

detector means including a pole antenna coupled with said cavity for providing a detector signal indicative of the electric field intensity of said cavity when the cavity is loaded and energized;

an indicator for visually indicating the level of the electric field intensity detected by said detector means; and a manually operable control part located on a control panel for varying the operating frequency of said microwave power source within said predetermined frequency range so that a maximum level of the electric field intensity is indicated by said indicator.

* * * * *